United States Patent [19]

Kramer et al.

[11] Patent Number: 4,529,173

[45] Date of Patent: Jul. 16, 1985

[54] SHIELDING DEVICE TO REDUCE WIND VELOCITY

[76] Inventors: Carl Kramer, Am Chorusberg 8; Hans-Joachim Gerhardt, Lousbergstrasse 58, both of 5100 Aachen; Ulrich Kreft, Waldehorst, 4971 Hüllhorst-Tengern, all of Fed. Rep. of Germany

[21] Appl. No.: 562,060

[22] Filed: Dec. 16, 1983

[30] Foreign Application Priority Data

Dec. 22, 1982 [DE] Fed. Rep. of Germany ..... 3247602

[51] Int. Cl.[3] ..... E01F 7/02

[52] U.S. Cl. ..... 256/12.5; 104/279; 256/24

[58] Field of Search ..... 256/12.5, 1, 31, 24; 104/279

[56] References Cited

U.S. PATENT DOCUMENTS

| | | | |
|---|---|---|---|
| 1,545,909 | 7/1925 | McKinnon | 256/12.5 |
| 1,668,651 | 5/1928 | McKinnon | 256/12.5 X |
| 1,773,128 | 8/1930 | Barrus | 256/12.5 X |
| 2,765,994 | 10/1956 | Jordanoff | 256/12.5 X |

FOREIGN PATENT DOCUMENTS

| | | | |
|---|---|---|---|
| 346913 | 1/1922 | Fed. Rep. of Germany | 256/12.5 |

*Primary Examiner*—Andrew V. Kundrat

*Attorney, Agent, or Firm*—Armstrong, Nikaido, Marmelstein & Kubovcik

[57] ABSTRACT

A shielding device to reduce wind velocity, in particular for the deposition of drifting sand or snow, has several plane elements which may be erected next to each other at an approximate right angle to the oncoming direction of the wind. The height of the individual plane elements amounts to at least twice the width of their base, whereas their width decreases as the height increases.

13 Claims, 2 Drawing Figures

SHIELDING DEVICE TO REDUCE WIND VELOCITY

Figure 1:
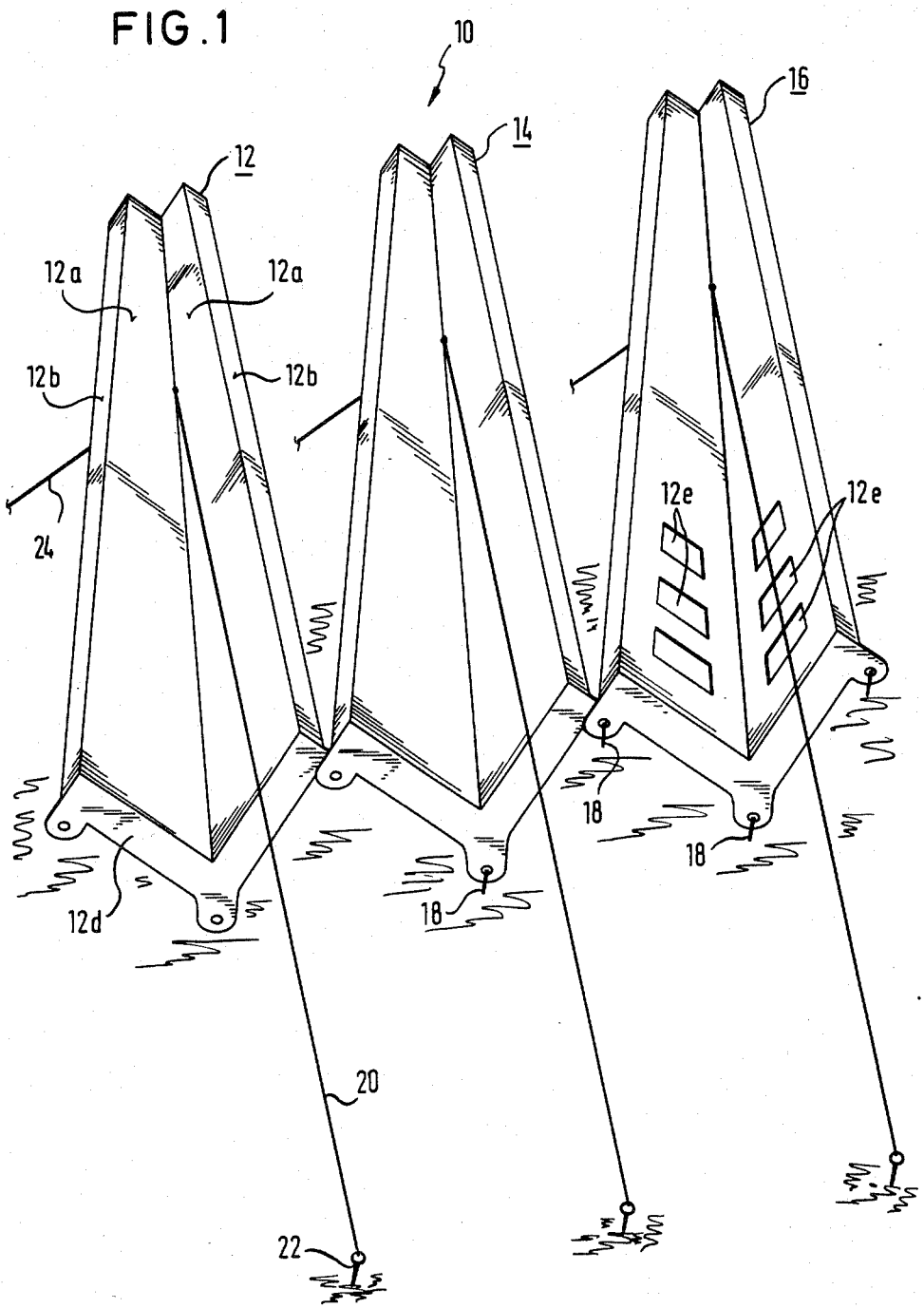

This invention relates to a shielding device to reduce wind velocity.

A shielding device of this type may be widely used where "wind-break" zones are required, for example on motorway bridges where strong cross-winds are often a hazard to the traffic.

A preferred use of such a shielding device is for the deposition of solid materials which are carried by the wind, in particular drifting sand or snow.

Sand drifts become a major problem in sandy dessert areas, for example where constructional installations, industrial buildings and traffic routes are to be constructed, operated and used. The climatic conditions are unsuitable for the cultivation of plants which would bind the sand in a natural way. Therefore, the only remaining possiblity is to use special shielding devices to define regions in which drifting sand is to be deposited. Compact walls or fences are available for this purpose, of the type which is also used to protect roads against snow drifts. However, a zone which has sufficiently stable flow characteristics is not produced behind a wall of this type. Instead, a relatively high-energy backflow occurs which may even result in an increased erosion of the ground in the corresponding region behind the wind-shield wall.

Similar problems arise in the case of wind shield fences which substantially consist of horizontal strips or laths. In this case as well, there is produced between the ground and the lowest board a split flow which causes an increased erosion immediately behind the fence. The depositing effect of such fences is thus not very satisfactory.

An object of the present invention is to provide a shielding device to reduce wind velocity, in which the above mentioned disadvantages do not arise.

In particular, a shielding device is to be proposed which allows the formation of a precisely defined zone which has stable flow characteristics.

This object is achieved according to the present invention by the features set out in the characterizing part of claim 1.

Appropriate embodiments are provided in the subclaims.

The advantages which are achieved with the present invention are based in particular on the use of a shielding device which is intentionally designed to be permeable to wind, as a result of which a wake region having a regularly reduced wind velocity and without a pronounced wake vortex is produced on the downstream side of the shielding device. These wind-shielded zones on the side of the shielding device remote from the wind have a width which increases downwards in a vertical direction, so that a pronounced deposition of the particles carried by the wind is produced without being influenced by a wake vortex, as occurs in the known fences for intercepting sand or snow.

Good results are obtained when the permeability of a shielding which is formed by several plane elements is from about 30 to 70%.

The individual plane elements appropriately have a triangular or trapezoidal front surface, as a result of which the desired shape, namely a reduction of width as a height of the elements increases, is produced in a simple manner in terms of production.

According to a preferred embodiment, closeable openings are provided in the lower region of at least individual plane elements. The wind permeability of the shielding may be adapted to the local conditions by partly or completely opening or closing these openings. If, for example the velocity profile of the wind is fuller near the ground, as is the case, for example on a knoll, the lower openings are opened and thus a greater permeability is obtained in the immediate vicinity of the ground.

However, where a wind velocity profile has a comparatively low speed near the ground, then to achieve an optimum deposition, a smaller permeability is more favourable in the lower region, i.e. the openings are closed.

Another variation of the wind permeability is possible by varying the spacing between the individual plane elements, thereby also making it possible to adapt the wind permeability of the shielding to the atmospheric conditions on the construction site.

However, the openings in the lower region of the plane elements provide a further advantage, since they suppress the oscillating vortex zones which otherwise build up behind relatively large, vertical plane elements.

The plane elements are appropriately profiled in horizontal cross section, and are for example wing-shaped, so that as a result of the deflection of the flow close to the wall which takes place at the flow-away edges, the aerodynamically effective width of the individual plane element is greater than its geometric width. Moreover, a profiling of this type produces a favourable stiffening of the individual elements.

The side edges of the plane elements are appropriately provided with flanges which also increase the rigidity and, at the same time, make it possible for the flow-away direction of the wind/sand flow to be influenced in a definite manner.

Flanges consisting of a metallic material are appropriately worked into the foot region of the individual plane elements to facilitate the attachment of the elements to the ground. These flanges are provided with holes through which pegs may be hammered into the ground.

The individual plane elements may be erected singly or joined together, and in the latter case, the individual flanges overlap in the region of the ground.

Special stakes which necessitate complex foundations, in particular in sand desert areas, are not required for the erection of the shielding device, and it is quite sufficient for the individual plane elements to be fixed with conventional sand pegs and supported by tensioning cords.

During assembly, it must merely be ensured that the axes of the open and closed surfaces are in a vertical position and that the open surfaces are not interrupted by closed surfaces, unlike the case of conventional shielding fences.

In such a sheltered region having a greatly reduced wind velocity behind closed plane elements, the width of which increases downwards due to the triangular or trapezoidal form, the particles of solid bodies carried by the wind may be deposited substantially more easily than behind a conventional type of wind-shield fence, in which the closed surfaces are joined together in the manner of a cross-lattice.

The plane elements appropriately do not contain any horizontal projections, discontinuities, flanges and the like on the side remote from the oncoming direction of the wind, which projections etc. would be completely covered by the solid body particles which are deposited, and which would complicate the removal of the plane elements.

The plane elements may be produced from glass fibre reinforced plastics, metal or a suitable UV-resistant plastics material. The UV- and weathering resistance is important because of the extreme climate in desert regions.

The shape of the front surface and the profiled form of the plane elements is appropriately designed so that the individual elements may be stacked inside one another in a tightly fitting manner. Transport and storage do not then pose any problems.

The present invention will now be decribed in more detail in the following using embodiments and with reference to the accompanying schematic drawings.

Figure 2:
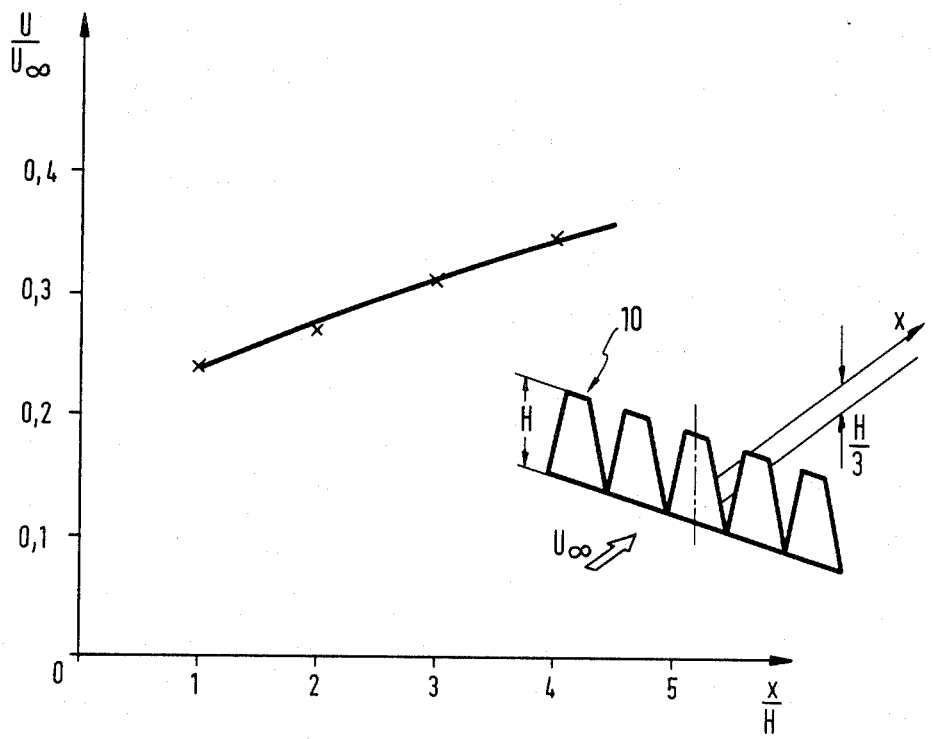

FIG. 1 shows a perspective view of a "shielding wall" consisting of three plane elements, and FIG. 2 shows a curve representation of the mode of operation of a shielding device of this type.

The shielding device which is generally indicated in FIG. 1, by reference numeral 10 has several plane elements which are erected adjacently, substantially perpendicularly to the oncoming direction of the wind, and of which three plane elements 12, 14 and 16 are shown in FIG. 1. The elements 12, 14 and 16 are all identical in shape, which will be described in the following with reference to the plane element 12.

This plane element 12 substantially consists of two planar surfaces 12*a* of a generally trapezoidal shape which are positioned vertically and form together an obtuse angle, so that an almost vertical edge is produced to the oncoming wind.

Thus, from the front, i.e. seen in the oncoming direction of the wind, the plane element 12 is trapezoidal, as is also indicated in FIG. 2.

The side edges of the two surfaces 12*a* have vertical flanges 12*b* which are positioned at an obtuse angle to the surfaces 12*a*, so that the plane element 12 is generally gull-wing shaped in a horizontal cross section, having forwardly directed flanges 12*b*.

In the foot region of the plane element 12 there are provided flanges 12*d* which project in a generally horizontal direction forward, i.e. against the direction of the wind, into which a metallic material may be worked. These flanges 12*d* have holes through which pegs 18 may be introduced.

Certain plane elements, for example the righthand element 16 in the shielding according to FIG. 1, are provided with generally rectangular openings 12*e* in their lower region, i.e. in the lower part of the surfaces 12*a*. These openings 12*e* may be at least partly closed. Consequently the permeability of the individual plane elements 12, 14 and 16 are thus of the shielding device 10 may be adapted to local conditions.

The elements 12, 14 and 16 are made of glass fibre reinforced plastics, metal or a suitable UV-resistant plastics material.

The plane elements 12, 14 and 16 do not have any projections, flanges etc. on the side remote from the direction of the wind, so that the elements 12, 14 and 16 may be stacked inside one another by being suitably designed.

This shielding device 10 is assembled as follows. The individual plane elements 12, 14 and 16 are attached to the ground by pegs 18 which are hammered through the holes in the flanges 12*d*. The elements are then braced by means of tensioning ropes 20, 24 which are attached to the ground by pegs 22 on the one hand and to the middle of the elements 12, 14, 16, i.e. in the region of the oncoming-wind edge, on the other hand.

In the embodiment according to FIG. 1, the flanges 12*d* overlap each other at their end regions, so that the outer pegs are each used to secure two adjacent plane elements.

However, as an alternative, it is also possible to erect the individual plane elements 12, 14 and 16 separately from each other.

FIG. 2 shows the mode of operation of the shielding 10 according to FIG. 1, the oncoming velocity of the wind being indicated by $U_\infty$. Wind at this velocity blows from the front, i.e. in the direction x, against the plane elements, which each have a trapezoidal front surface.

FIG. 2 shows the course of the local velocity U, based on the undisturbed oncoming velocity $U_\infty$, behind the shielding device 10 for a horizontal reference axis in the x-direction, namely in the case of a vertical ground spacing which corresponds to a third of the height H of the plane elements 12, 14 and 16.

The curve shows that in a horizontal region behind the shielding 10, the horizontal length of which corresponds to about four times the height H, the ratio of $U:U_\infty$ is less than one-third, i.e. in this region the local velocity U is less than one-third of the undisturbed oncoming velocity $U_\infty$.

Particles of solid bodies carried by the wind, i.e. in particular particles of snow and sand, are deposited in this heavily protected wake area, the wind velocity of which is reduced.

Once the region behind the shielding 10 device has filled up with the solid body particles, the individual plane elements 12, 14 and 16 may be easily pulled out upwards, after the pegs and tensioning ropes have been released, because there are no horizontal projections on the surface of the plane elements remote from the direction of the wind which would be covered by the particles and would complicate the removal of the elements.

The individual plane elements may then be re-erected on a different site.

We claim:

1. A shielding device to reduce wind velocity, comprising:

(a) a plurality of elements positioned adjacent one another and generally aligned in a plane located at a right angle to the oncoming direction of the wind.

(b) each of said elements having a width which decreases as the height thereof increases, and a vertical height (H) which is at least twice the width of a base of the element.

2. A shielding device according to claim 1, wherein the front surface of the elements is trapezoidal in shape.

3. A shielding device according to claim 1, wherein side edges of each of said elements have flanges extending generally forwardly into the wind direction.

4. A shielding device according to claim 1, wherein at least one of said elements is provided with openings in its lower region.

5. A shielding device according to claim 4, wherein said openings are partially closable.

6. A shielding device according to claim 1, wherein said elements are profiled in horizontal cross section.

7. A shielding device according to claim 1, wherein each element is gull-wing shaped in horizontal cross section.

8. A shielding device according to claim 1, wherein each element is individually supported by tensioning ropes and pegs.

9. A shielding device according to claim 1, wherein individaul elements are made of glass fiber reinforced plastics.

10. A shielding device according to claim 1, wherein each element has metallic flanges in the foot region thereof for providing support for the element.

11. A shielding device according to claim 10, wherein each of said flanges in the foot region of the elements have holes for receiving pegs.

12. A shielding device according to claim 1, wherein the elements do not have any horizontal discontinuities of flanges on the side remote from the oncoming direction of the wind.

13. A shielding device according to claim 12, wherein the individual elements are stackable with one another in a tightly fitting manner for economical storage.

* * * * *